United States Patent [19]

Newman et al.

[11] 4,269,686

[45] May 26, 1981

[54] APPARATUS FOR PLATING JOURNALS OF CRANKSHAFTS

[76] Inventors: Aubrey W. Newman, 416 E. 45th St.; J. E. Coffey, 4018 Lakeside Dr.; Arthur D. Whitney, 807 New Castle Ct., all of Odessa, Tex. 79762

[21] Appl. No.: 110,506

[22] Filed: Jan. 8, 1980

[51] Int. Cl.[3] ..... C25D 17/00; C25D 7/00

[52] U.S. Cl. ..... 204/212; 204/15; 204/224 R

[58] Field of Search ..... 204/212, 213, 218, 15, 204/199–201, 224 R

[56] References Cited

U.S. PATENT DOCUMENTS

| | | | |
|---|---|---|---|
| 1,880,382 | 10/1932 | Garling et al. | 204/15 |
| 2,473,290 | 6/1949 | Millard | 204/212 |
| 2,530,677 | 11/1950 | Berkenkotter et al. | 204/212 |
| 2,782,159 | 2/1957 | Berry | 204/212 |
| 2,931,764 | 4/1960 | Pyles | 204/212 |
| 2,940,917 | 6/1960 | Dyson | 204/212 |
| 3,001,925 | 9/1961 | Berry | 204/224 |

*Primary Examiner*—F. C. Edmundson
*Attorney, Agent, or Firm*—Marcus L. Bates

[57] ABSTRACT

Apparatus for electroplating bearing surfaces of a crankshaft while the crankshaft is submerged in a plating tank containing a plating bath. A current conducting mount means is affixed to and rotatably supports a plurality of crankshafts submerged in the plating bath. The mount means includes a cylindrical housing having a spindle which extends therethrough so that one end of opposed crankshafts can be attached to opposed ends of the spindle, thereby enabling several crankshafts to be simultaneously electroplated. Seal means forms a mercury chamber between the housing and the spindle, and another seal means located at opposed ends of the housing forms a bearing chamber which protects a bearing means from the plating bath. Hence, the bearings are protected from the mercury by one of the seal means and from the plating bath by the other seal means. An anode circumferentially encloses each of the journals of the crankshaft to be plated and effectively prevents the deposit of metal on surfaces of the crankshaft other than the journal to be plated. The above described apparatus enables current to flow from a source, into the mercury, to the spindle, and into the crankshaft. Current then flows through the plating bath to the anode and back to the current source.

14 Claims, 9 Drawing Figures

APPARATUS FOR PLATING JOURNALS OF CRANKSHAFTS

BACKGROUND OF THE INVENTION

Berry U.S. Pat. No. 3,001,925; Pyles U.S. Pat. No. 2,931,764; Berry U.S. Pat. No. 2,782,159; Berkenkotter et al U.S. Pat. No. 2,530,677; Millard U.S. Pat. No. 2,473,290; and Garling et al U.S. Pat. No. 1,880,382 are prior art examples which disclose various different apparatus for electroplating bearing surfaces of a crankshaft when the shaft is submerged in a plating tank containing a plating bath. In these and other known prior art examples of similar apparatus, difficulty has been experienced in conducting current to the crankshaft while concurrently rotating the shaft about the longitudinal axis thereof.

Most crankshafts are massive, and often weigh several hundred pounds. During the electroplating process, the shafts must be rotated for many hours while submerged in a chromic acid electrolyte. A rotatable support means usually supports the shaft and simultaneously provides a means by which current flow to the submerged shaft is achieved. The rotatable support means preferably is provided with a sealed chamber containing mercury so that the mercury simultaneously wets a rotating shaft and housing of the rotatable support means, thereby enabling the housing to become an electrical conductor as well as a main load transferring member by which the weight of the rotating crankshaft is supported within the chromic acid bath. However, the bearings contained within the housing must be lubricated while simultaneously protected from the mercury located on one side thereof as well as the chromic acid solution located on the other side thereof. The chromic acid is incompatible with the bearings; and the mercury, when admixed with the bearing lubricant, is also fatal to the bearing. Accordingly, it is necessary to isolate the mercury from the bearing means and concurrently isolate the bearing means from the chromic acid solution. A current conducting rotating support means which achieves this desirable result is the subject of the present invention.

The current is transferred from the source, through the rotating support means, into the crankshaft, and through the chromic acid solution to an anode. The anode, in accordance with some of the above mentioned prior arts, circumferentially surrounds part of the crankshaft journal to be plated. The anode must be placed in spaced relationship to the journal to be plated, and care must be taken to avoid deposition of chromium on any part of the crankshaft other than the journal to be plated.

Another aspect of the present invention is the provision of improvements in anodes which attain this desirable result, to thereby provide a combination of elements which constitutes the current flow path for the entire plating process.

SUMMARY OF THE INVENTION

This invention comprehends apparatus for electroplating bearing surfaces of a crankshaft when submerged in a plating tank containing a plating bath. More specifically, this invention sets forth apparatus by which current flows from a source to a rotating support means which supports a plurality of crankshafts when submerged within a plating bath, and wherein current flows from the rotating support means into the crankshaft, whereupon the current then flows from the bearing surfaces of the crankshaft, into the plating bath, to an anode spaced from said bearing surfaces, and back to the current source.

The rotating support means includes a cylindrical housing having a spindle axially aligned along the central longitudinal axis thereof, with there being spaced bearing means which rotatably supports the spindle within the housing. Spaced seal means mounted between the interior of the housing and the exterior of the spindle form a mercury chamber within the housing so that current can flow into mercury contained within the chamber and into the rotatable spindle. External seal means located on either side of the bearings isolate the bearings from the plating bath. The spindle includes opposed ends which extend from the housing and are connected to one end of a crankshaft, so that a crankshaft can be rotatably supported on either end of the spindle.

Employment of two spaced current conducting mount means enable three or more shafts to be simultaneously electroplated, and in some instances, additional shafts can be series connected to various different ones of the supported shafts.

In order to complete the current flow from the bearing surfaces of a crankshaft, an anode made in accordance with the present invention circumferentially extends about part of the bearing surface to be plated, and isolates the bearing surface from the rest of the shaft so that only the bearing surface is electroplated.

Accordingly, a primary object of the present invention is the provision of improvements in apparatus for electroplating bearing surfaces on a crankshaft when submerged in a plating tank containing a plating bath.

Another object of the present invention is the provision of a combination of elements for electroplating bearing surfaces of a crankshaft wherein current is conducted from a current source, into a rotating current conducting support means, into a plurality of crankshafts, where a special anode spaced from the bearing surface to be electroplated completes the electrical circuitry back to the current source.

Another and still further object of the present invention is the provision of a rotatable current conducting mount means which supports a crankshaft when submerged in a plating tank, wherein the mount means include bearing means having a seal means which isolates the bearing means from the plating bath.

A still further object of the present invention is the provision of an improved anode for electroplating bearing surfaces of a crankshaft which circumferentially extends in spaced relationship about part of the bearing surface to be plated and which prevents deposition of metal on the crankshaft except on the bearing surface to be plated.

These and various other objects and advantages of the invention will become readily apparent to those skilled in the art upon reading the following detailed description and claims and by referring to the accompanying drawings.

The above objects are attained in accordance with the pressent invention by the provision of a combination of elements which are fabricated in a manner substantially as described in the above abstract and summary.

DETAILED DESCRIPTION OF THE PREFERRED EMBODIMENT

Figure 1:
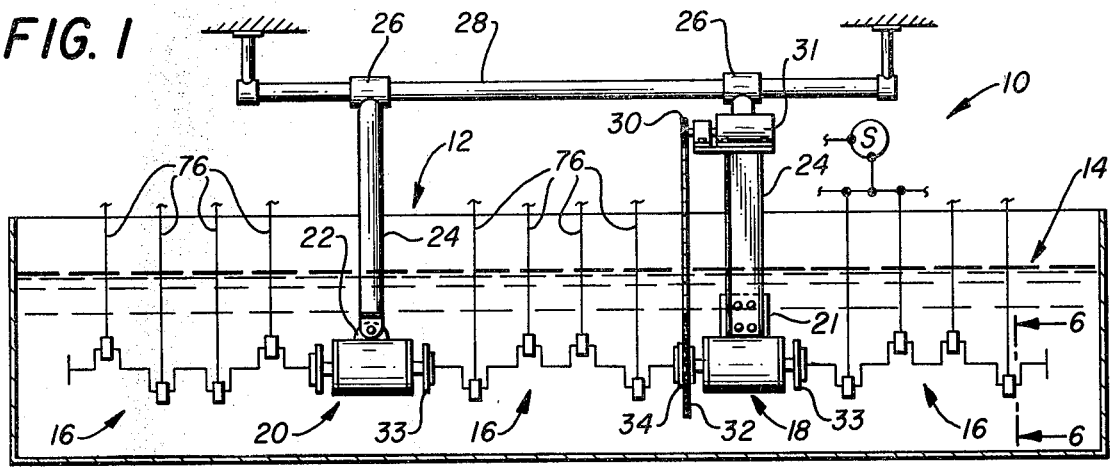
FIG. 1 is a part diagrammatical, part schematical illustration of apparatus for electroplating bearing surfaces of a crankshaft when submerged in a plating tank containing a plating bath.

In FIG. 1, there is diagrammatically disclosed a chrome plating process 10 for electroplating bearing surfaces of a crankshaft when submerged within a plating bath contained within an electrolytic tank 12. The bath has a surface level 14, and a plurality of crankshafts 16 are rotatably supported submerged below the liquid level and within the plating bath so that the shafts are rotated about the longitudinal axial centerline thereof while being plated.

Each of the shafts are supported by a rotating conductor 18 and 20, made in accordance with the present invention. The rotating conductor 18 includes a fixed bracket at 21, while the rotating conductor 20 includes a swivel-type bracket at 22. Vertical support members 24 are affixed to brackets 21 and 22 and include a swivel-type journal at 26 which slidably encapsulates a marginal length of a horizontal support member 28. Member 28 is supported by any convenient means in overhanging relationship respective to the tank 12.

It should be evident from the foregoing description that rotating conductors 18 and 20 can pivot about the horizontal member 28, while rotating conductor 20 can also pivot from a horizontal plane by means of the aforesaid swivel 22.

A drive sprocket 30 is connected to a prime mover 31, which preferably is an electric motor which drives a gear box which in turn drives the sprocket 30. The sprocket 30 drives a driven sprocket 32 which concurrently is directly connected to rotate crankshaft flange attachments 33 and 34.

Figure 2:
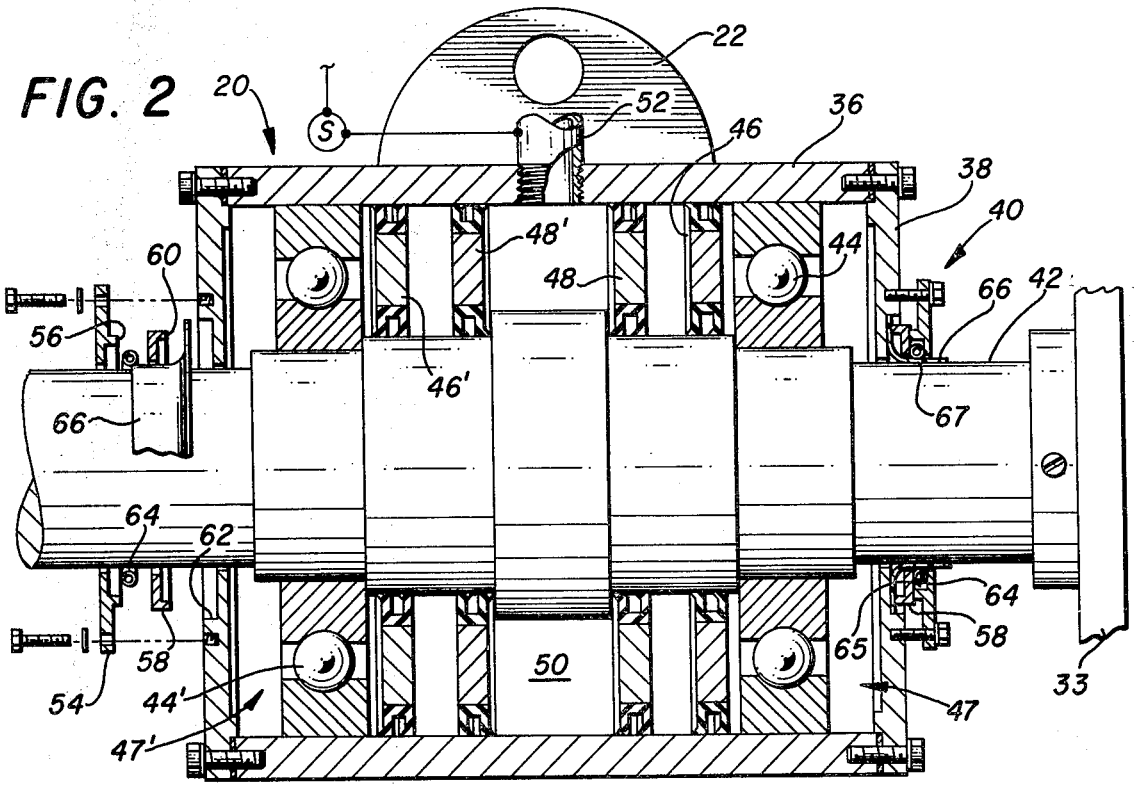
FIG. 2 is an enlarged, fragmentary, part cross-sectional representation of part of the apparatus disclosed in FIG. 1.
Figure 3:
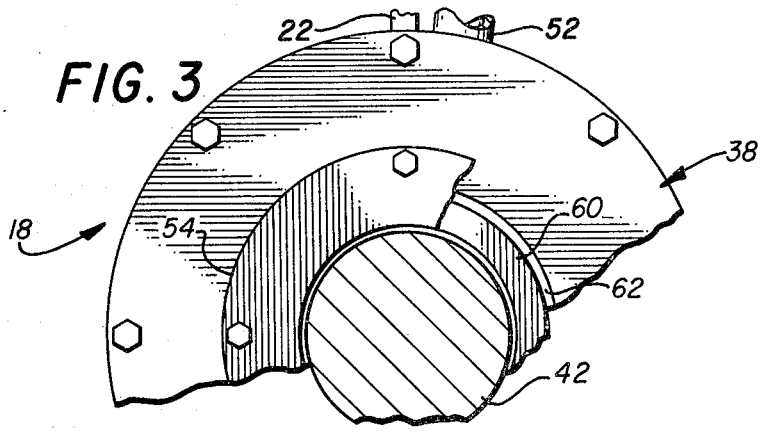
FIG. 3 is a fragmentary, end view of the apparatus disclosed in FIG. 2.
Figure 4:
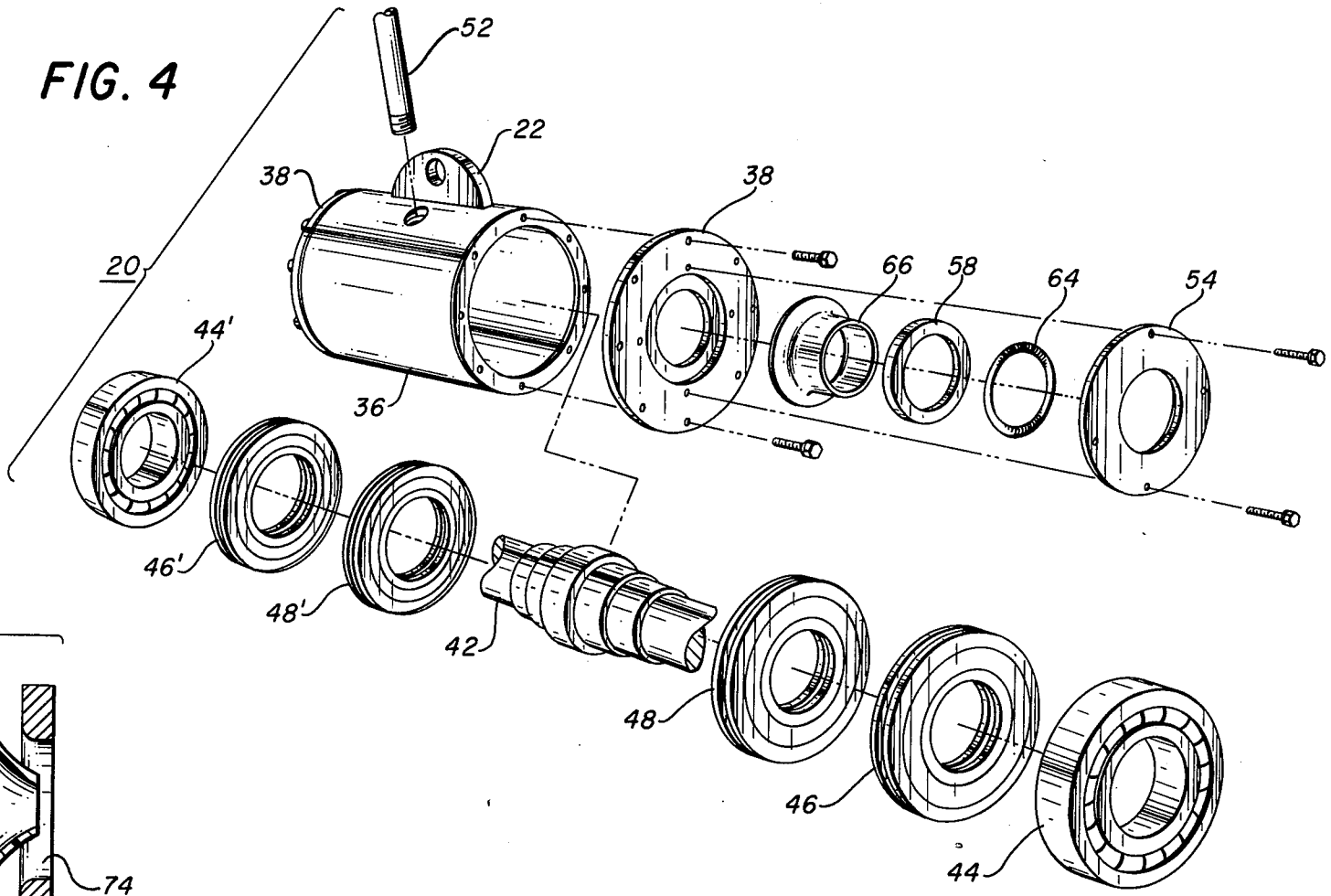
FIG. 4 is an exploded view which sets forth details of the apparatus disclosed in FIGS. 2 and 3.

FIGS. 2–4 illustrate the details of the rotating support conductors 18 and 20. The rotating conductors include a cylindrical housing 36 having opposed removable end plates 38 to which there is secured an outer seal assemble 40, made in accordance with the present invention.

A support spindle 42 extends axially through the housing and presents opposed ends to which there is secured the before mentioned crankshaft flange attachments 33 and 34.

Main support bearings 44, 44' rotatably supports the spindle at spaced apart locations in the illustrated manner of FIG. 2. Spaced apart grease seals 46, 46' form the spaced bearing chambers 47, 47' within which the bearings are lubricatingly housed. Spaced apart mercury seals 48, 48' form an isolated mercury containing chamber 50 which is in communication with conduit 52. The conduit 52 is connected to the illustrated source of current.

It can therefore be seen that the outer seal means 40 and inner seal means 46 form an isolated grease containing chamber 47, while the innermost seal means 48 forms an isolated mercury containing chamber 50. For this reason, the seal 46 has the seal element thereon oriented to prevent flow of grease from chamber 47 towards seal 48, while the seal 48 is oriented to cause the seal element thereof to prevent flow of mercury from chamber 50 towards seal 46. Accordingly, when chamber 50 and conduit 52 are filled with mercury, current can flow from the source S into the spindle and to the crankshafts to which the crankshaft flange attachments are connected, while seal 40 prevents contamination of bearing 44 with chromic acid, and seals 46 and 48 prevent the mercury witin chamber 50 from contaminating the grease within chamber 47 and vice versa.

As particularly illustrated in FIG. 2, together with FIGS. 3 and 4, the seal assembly of this invention includes a pressure plate 54 having a circumferentially extending boss 56 arranged on the inside face thereof which bears against the outer face of an annular ring 58. The ring includes a circumferentially extending boss 60 on the inside face thereof which is received within an annular recess 62 formed on the outer face of the end plates 38. A spring 64 circumferentially extends about a resilient seal member 66. The spring is captured within a chamber 65 which is formed between the pressure plate boss and outer ring face.

A marginal edge portion of the large o.d. end of the resilient seal is contacted by the boss 60 of the ring so that it is sealingly engaged with respect to a circumferentially extending annular area of the recess 62. A medial circumferentially extending body portion of the resilient seal extends through the interior of the pressure plate and the ring, with there being a marginal length of the small o.d. end thereof freely extending outwardly away from the pressure plate. The endless coiled circular spring 64 biases a medial body portion of the resilient seal into sealing engagement with a marginal length of the spindle. Lubricant from chamber 47 is therefore free to flow towards the coacting surface area formed between the resilient seal member 66 and the portion of the spindle which is placed in contact therewith.

Figure 5:
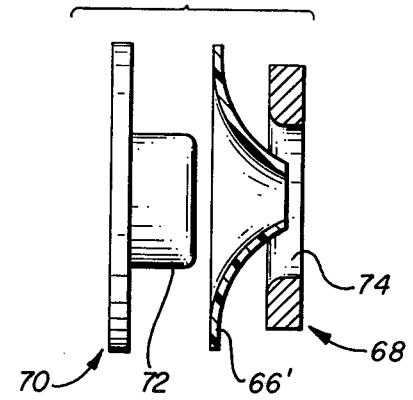
FIG. 5 is a part cross-sectional representation of an apparatus used in fabricating one of the seals disclosed in FIGS. 2–4.
Figure 6:
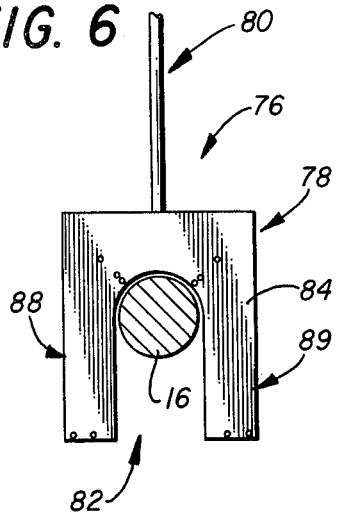
FIG. 6 is an enlarged, cross-sectional view taken along line 6—6 of FIG. 1.
Figure 7:
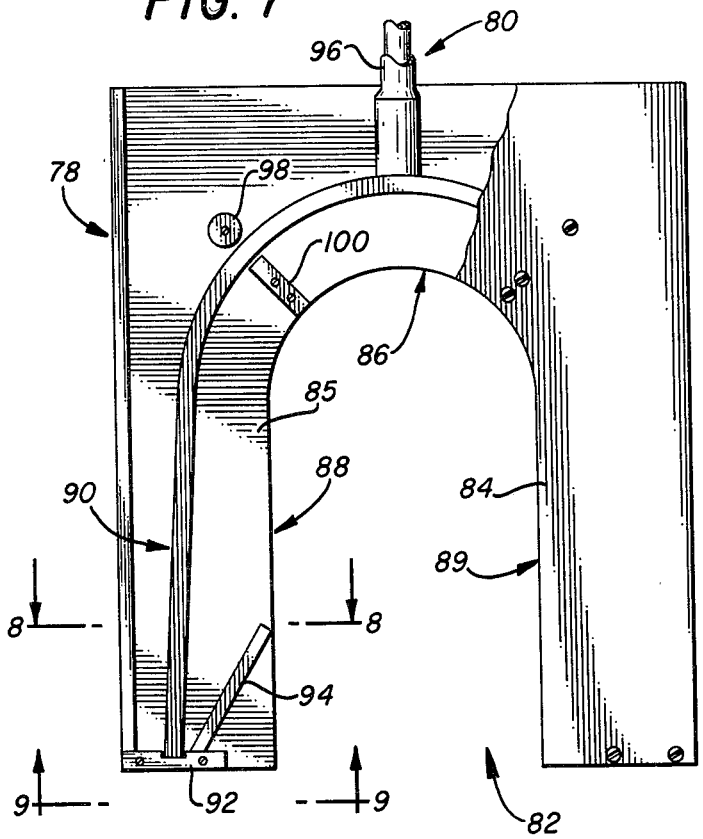
FIG. 7 is a further enlarged, broken view of the apparatus disclosed in FIG. 6, with some parts being broken away therefrom in order to disclose the interior thereof.
Figure 8:
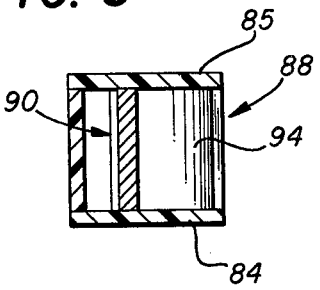
FIG. 8 is a cross-sectional view taken along line 8—8 of FIG. 7.
Figure 9:
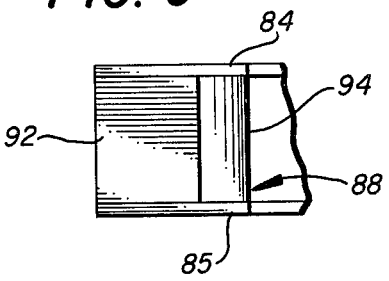
FIG. 9 is a view of part of the apparatus disclosed in FIG. 7, taken along line 9—9 of FIG. 7.

The resilient seal 66 is fabricated in accordance with the teachings of FIG. 5, wherein a female die 68 telescopingly receives a complimentary male die 70, such that male portion 72 deforms a heated plastic sheet material 66' as it is forced into the circular female receptacle 74. The coacting male and female members 68 and 70 deform the sheet of seal material 62 therebetween so that the resultant configuration seen in FIG. 2 is achieved. The assembled die and seal are placed into a deepfreeze until it is needed for assembly of seal 40. At that time, the seal is assembled in the manner of FIG. 2. This expedient maintains the plastic material 66' in a deformed configuration until the assembly thereof is effected, whereupon seal 66 thereafter maintains the configuration set forth in FIG. 2 of the drawings.

The formed plastic seal is made of polyvinyl cloride having the trade name "Korseal." It is a flexible sheet of plastic material which is heated to the boiling point of water, pressed in the mold of FIG. 5, reduced in temperature to below the freezing point of water, removed from the mold, and put inside the seal retainer on the shaft while frozen, where it then maintains its form. The spring is made of titanium which resists the detrimental action of the chromic acid.

FIGS. 6–9 illustrate the details of a rotating, chrome plating fixture hereinafter referred to as an anode. The anode is seen illustrated at 76 in FIG. 1. The anodes each include a rectangular housing 78 having an insulated conductor 80 which supports the housing about a bearing surface of the crankshaft to be plated. The housing is in the form of a horseshoe in that it is provided with a U-shaped opening 82 which receives the bearing surface 16 of the crankshaft therewithin in the illustrated manner of FIG. 6. The housing includes opposed faces 84 and 85, made of non-conductive material, which are maintained in spaced relationship respective to one another. Numeral 86 indicates the radius of curvature of the U-shaped opening which preferably is slightly greater than the o.d. of the bearing surface to be plated. The housing is formed into hollow legs 88 and 89. An anode 90, preferably made of lead, extends into the illustrated groove formed within an end cup 92. Guide member 94 serves the dual purpose of preventing deposition of metal onto the crankshaft at areas other than the bearing surface to be plated, and presenting a guide for the marginal end of the anode.

Conductor 96 connects the insulated conductor 80 to the central portion of the anode. Spacers 98 and 100 maintain the anode properly positioned within the housing. Members 92, 98, and 100 additionally provide a means by which the opposed plates 84 and 85 are maintained in assembled relationship, and by which the entire assembly can be disassembled for overhaul. Member 100 is made of plexiglass (T.M.) and provides a wear surface between the crankshaft journal and the anode assembly.

The anodes 76 each encapsulate a circumferentially extending portion of the bearing surface to be plated, with the anode being uniformly spaced from the rotating bearing surface by means of the circular spacer members 86 and 100.

The material of construction from which the anode is fabricated preferably is a lead grid having a multiplicity of perforations formed therein. The lead grid is formed on a surface similar to a waffle iron and cut into strips, bent into a horseshoe configuration, and the conductor welded to the medial body portion thereof. Elements 100 are wear blocks which extend down into tangential relationship respective to curve 86. The wear blocks or rider blocks 100 are made of plexiglass. The body of the anode assembly is made of any suitable material which is compatible with the plating bath, but preferably is made of lead.

The present invention enables a plurality of crankshafts to be simultaneously plated. It is possible to plate six shafts simultaneously which effects a tremendous savings. This is achieved by connecting two relatively small shafts between the rotating conductors, with there being two series connecting shafts connected to either of the other ends of the two spindles.

I claim:

1. A chrome plating apparatus for simultaneously plating selected areas of a plurality of crankshafts, wherein the crankshafts are rotatably supported within a plating bath with the longitudinal axis thereof being disposed horizontally while current flows between an anode and the selected area of the crankshaft to be plated; the improvement comprising:

a rotating conductor having a main fixed housing, a rotatable spindle journaled within said housing and arranged with the longitudinal axial centerline thereof coinciding with the axial bore of the housing so that opposed ends of the spindle extend from either opposed end of the housing;

spaced internal seal means located within said housing and forming a centrally located mercury chamber which is defined by the inner wall surface of the chamber, the outer wall surface of the spindle, and the inner surface of the seal means;

spaced external seal means located at each opposed end of the housing and defining opposed grease chambers, a bearing means within each grease chamber which rotatably supports the spindle from said housing;

means on opposed ends of the spindle for supportingly engaging one end of a crankshaft;

whereby one end of a crankshaft can be affixed to each end of the spindle, thereby enabling a plurality of crankshafts to be simultaneously rotatably supported within a plating bath.

2. The improvement of claim 1 wherein said rotating conductor includes opposed apertured end plates, the marginal ends of the spindle extends through said aperture with there being an annulus formed therebetween, said external seal means being affixed to said end plate and positioned to seal said annulus;

said seal means includes a ring, a spring, a pressure plate, and a resilient seal member; said seal member includes a circumferentially extending sidewall which curves from a large diameter end to a small diameter end;

the large diameter marginal end of the resilient seal member is sealingly forced against the outer face of the end plate by said ring, means by which said pressure plate forces the ring towards the end plate, a cavity formed between said ring and pressure plate within which the spring is captured, the small diameter marginal end of the resilient seal member extends about the spindle and within the ring, pressure plate, and spring so that the spring biases the seal member against the outer periphery of the spindle.

3. The improvement of claim 2 wherein the resilient seal member is made of polyvinyl chloride;

said spindle having a sprocket attached to one end thereof, and means, including a chain drive, by which the spindle is rotated.

4. The improvement of claim 1 wherein there are two rotating conductors adapted to be placed within the plating bath, said two rotating conductors are spaced from one another with the spindles thereof aligned along a common axis so that a crankshaft can be affixed to adjacent spindle ends and other crankshafts affixed to the far ends of the spindle, thereby enabling a plurality of crankshafts to be simultaneously plated.

5. The improvement of claim 4 wherein one of the rotating conductors is rigidly affixed to a vertical support member while the other rotating conductor is affixed to a vertical support by a swivel, a horizontal support member extending parallel to the swivels, the other end of each vertical support member is affixed to the horizontal support member by a journal member; so that as the rotating conductors impart rotational motion into the crankshafts, misalignment along the longitudinal axis thereof is accommodated by the journal member and swivel.

6. The improvement of claim 1 wherein there are two said rotating conductors, one of the rotating conductors is rigidly affixed to a vertical support member while the other rotating conductor is affixed to a vertical support by a swivel, a horizontal support member extending parallel to the spindle, the other end of each vertical support member is affixed to the horizontal support member by a journal member; so that any misalignment between adjacent crankshafts will be accommodated by relative lateral movement of the spindles.

7. In an apparatus for electroplating bearing surfaces of a crankshaft when submerged in a plating tank containing a plating bath, a rotating conductor by which the crankshaft is supported with the longitudinal axis thereof positioned substantially horizontal and for rotating the crankshaft about the longitudinal axis thereof whereby the rod journals thereof describe a circular motion; a plurality of anodes, each mounted adjacent to and uniformly spaced from one of the journals to be plated, the improvement comprising:

said rotating conductor includes a cylindrical fixed housing having an axial bore, support means by which said housing can be supported within a plating tank, a rotatable spindle axially aligned along said axial bore;

spaced bearings by which spaced marginal lengths of the spindle is rotatably supported from spaced marginal lengths of the inside wall of the housing, thereby leaving opposed marginal lengths of the spindle extending from opposed ends of the housing, and means on each opposed ends of the spindle for removably receiving one end of a crankshaft in mounted relationship thereon so that the longitudinal axis of each crankshaft is aligned with the axial centerline of the spindle;

spaced internal seal means located within said housing and inwardly of said bearing means for sealingly engaging spaced circumferentially areas on said shaft to thereby form an isolated mercury chamber;

an end plate affixed to each opposed end of the housing, an axial bore through each end plate, an external seal assembly affixed to each end plate for sealing the annulus formed between the spindle and the axial bore;

an intermediate seal means located between the bearing and the internal seal means which forms a grease chamber between said external seal means and the intermediate seal means;

so that current can flow from said mercury chamber, into said spindle, and into a crankshaft affixed to either end of the spindle.

8. The improvement of claim 7 wherein said seal means includes a ring, a spring, a pressure plate, and a resilient seal member; said seal member is in the form of a circumferentially extending sidewall having a large diameter end which converges rearwardly into a small diameter end;

the marginal large diameter end of said seal member is sealingly forced against the outer face of the end plate by said ring, means by which said pressure plate forces said ring towards the end plate, a cavity formed between said ring and said pressure plate within which said spring is captured, the marginal small diameter end of said seal member extends about the shaft and within the ring, pressure plate, and spring so that the spring biases the seal member against the outer periphery of the spindle.

9. The improvement of claim 8 wherein said anode is a rectangular piece of lead bent into a U-shape to provide spaced legs and a medial body part; and electrode affixed to the medial body part for conducting current from a source to the anode;

a rectangular housing made of non-conducting material and having a U-shaped cut-out to provide spaced legs, said anode being captured within said housing with the anode legs residing within the legs of the housing;

said housing being inwardly opened at said U-shaped cut-out to enable current to flow from the inside surface area of the anode directly towards the journal to be plated.

10. The improvement of claim 7 wherein there are two said rotating conductors spaced from one another, one of the rotating conductors includes means by which it is rigidly affixed to a vertical support member while the other rotating conductor includes means by which it is affixed to a vertical support by a swivel; a horizontal support member extending parallel to the shaft, the other end of each vertical support member being affixed to the horizontal support member by a journal member; so that one crankshaft can be mounted between the near ends of the adjacent spindles, while other crankshafts can be mounted to the far ends of the spindles; and, limited lateral misalignment of the crankshafts induces limited movement into the journal at the horizontal support member and into the swivel at the vertical support member.

11. In an apparatus for electroplating bearing surfaces of a crankshaft when submerged in a plating tank containing a plating bath, a current conducting mount means by which the crankshaft is supported with the longitudinal axis thereof positioned substantially horizontal and for rotating the crankshaft about the longitudinal axis thereof whereby the rod journals thereof describe a circular motion; a plurality of anodes, each anode being mounted adjacent to and uniformly spaced from one of the journals to be plated, a current supply connected between the anodes and the current conducting mount means; the improvement comprising:

said anodes each include a housing having front and rear plates spaced by opposed side walls, a U-shaped cut-out which forms spaced legs, the cut-out being of a size to receive the bearing surface therewithin; wear blocks held between the plates and located outwardly of said U-shaped cut-out, one end of said wear block bearing against the shaft, a U-shaped lead conducting member having each marginal end thereof received within a leg, a support conductor connected to the midportion of the lead member;

a shield located at an acute angle respective to the marginal end of the lead member; a closure plate which forms a closure member at the end of the leg while said shield isolates the marginal end of the lead member from the crankshaft;

said housing opens towards said lead conducting member so that current flow occurs from the inner surface of the lead member directly towards the journals to be plated, while the edge portion which forms the U-shaped cut-out rides against the journal to be plated and maintains the lead conducting member spaced a constant distance from the journal as the crankshaft rotates about its longitudinal axis.

12. The improvement of claim 11 wherein said current conducting mount means includes a pair of spaced rotating conductors, each of said rotating conductors having a main housing, a spindle journaled within said housing and arranged with the longitudinal axial centerline thereof coinciding with the axial bore of the housing so that opposed ends of the spindle extend from either of the opposed ends of the housing;

spaced internal seal means located within said housing and forming a centrally located mercury chamber which is defined by the inner wall surface of the chamber, the outer wall surface of the spindle, and the inner surface of the seal means;

spaced external seal means located at each said opposed end of the housing and defining spaced apart opposed grease chambers, a bearing within each grease chamber for rotatably supporting the spindle respective to the housing;

means on opposed ends of each said spindle for supportingly engaging one end of a crankshaft;

whereby one end of a crankshaft can be affixed to each end of a spindle, so that a plurality of crankshafts can be simultaneously rotatably supported within a plating bath.

13. The improvement of claim 12 wherein said rotating conductor includes opposed apertured end plates, the opposed marginal ends of said spindle extends through the aperture and leaves an annulus therebetween, said external seal means being affixed to said end plate and positioned to seal the annulus;

said external seal means includes a ring, a spring, a pressure plate, and a resilient seal member in the form of a circumferentially extending curved wall having a large diameter marginal end opposed to a small diameter marginal end;

the marginal large diameter end of the resilient seal being sealingly forced against the outer face of the end plate by said ring, means by which said pressure plate forces the ring towards the end plate, an annular cavity formed between said ring and the pressure plate within which the spring is captured, the small diameter end of the resilient seal extends about the spindle and within the ring, pressure plate, and spring so that the spring biases a medial length of the seal member against the outer periphery of the spindle.

14. The improvement of claim 13 wherein the seal member is made of polyvinyl chloride;

one of said rotating conductors is rigidly affixed to a vertical support member while the other rotating conductor is affixed to a vertical support by a swivel, a horizontal support member extending parallel to the swivels, the other end of each vertical support member is affixed to the horizontal support member by a journal member; so that as the rotating conductors impart rotational motion into the crankshafts, misalignment along the longitudinal axis thereof is accommodated by the journal member and swivel.

* * * * *